United States Patent [19]

Coleman

[11] 3,994,815

[45] Nov. 30, 1976

[54] ADDITIVE CONCENTRATES AND LUBRICATING COMPOSITIONS CONTAINING THESE CONCENTRATES

[75] Inventor: Lester Earl Coleman, Willoughby Hills, Ohio

[73] Assignee: The Lubrizol Corporation, Cleveland, Ohio

[22] Filed: Oct. 6, 1975

[21] Appl. No.: 619,987

Related U.S. Application Data

[63] Continuation-in-part of Ser. No. 543,395, Jan. 23, 1975, abandoned.

[52] U.S. Cl. ..... 252/52 R; 252/56 S; 252/59

[51] Int. Cl.[2] ..... C10M 1/16; C10M 1/20; C10M 3/10; C10M 3/14

[58] Field of Search ..... 252/52 R, 56 S, 59

[56] References Cited

UNITED STATES PATENTS

| | | | |
|---|---|---|---|
| 3,763,044 | 10/1973 | Anderson | 252/59 |
| 3,772,169 | 11/1973 | Small et al. | 252/59 |
| 3,775,329 | 11/1973 | Eckert | 252/59 |
| 3,795,615 | 3/1974 | Pappas et al. | 252/59 |
| 3,799,875 | 3/1974 | Rohde | 252/59 |

*Primary Examiner*—Delbert E. Gantz
*Assistant Examiner*—I. Vaughn
*Attorney, Agent, or Firm*—James W. Adams, Jr.; Edmund C. Ross, Jr.

[57] ABSTRACT

Additive concentrates comprising hydrogenated alkenyl-arene-conjugated diene interpolymers and a non-ester type synthetic lubricating oil diluent are disclosed. Lubricating compositions prepared from these concentrates are also disclosed.

19 Claims, No Drawings

ADDITIVE CONCENTRATES AND LUBRICATING COMPOSITIONS CONTAINING THESE CONCENTRATES

This application is a continuation-in-part of copending application U.S. Ser. No. 543,395, filed Jan. 23, 1975 and now abandoned.

The invention herein is concerned with a novel series of additive concentrates and to lubricating compositions containing these additive concentrations.

More specifically, the invention is concerned with additive concentrates comprising a viscosity index improver based upon hydrogenated alkenylarene-conjugated diene interpolymers and a non-ester type synthetic lubricating oil diluent or carrier, and to lubricating compositions comprising a viscosity index improving amount of the additive concentrate and a lubricating oil.

Recently, there has been developed a series of effective viscosity index improving agents for lubricating compositions based upon various hydrogenated alkenylareneconjugated diene interpolymers. These additive interpolymers are excellent modifiers for increasing the viscosity and improving the sheer stability and viscosity index of lubricating oils. As is discussed more thoroughly below, these interpolymer additives are based upon several types of alkenylarene-diene interpolymers which differ from each other, principally, in the steric arrangement of the polymerized monomers. The interpolymer products are subsequently hydrogenated to varying degrees.

The physical nature of these hydrogenated interpolymers or copolymers is such that they are supplied as baled material, crumbs or pellets and intensive mixing is necessary to formulate this material into the lubricating oil. The difficulties encountered during the formulation of certain lubricating compositions containing these hydrogenated copolymers have been enumerated in U.S. Pat. No. 3,630,905 issued to Sorgo and U.S. Pat. No. 3,772,169 issued to Small, et al. These two patents likewise propose solutions to these problems. The Sorgo patent discloses the preparation of an oil-extended copolymer composition comprising (a) 40–60 weight percent of the particular hydrogenated copolymer and (b) 60–40 weight percent of a paraffin oil. Large amounts of this oil-extended composition are prepared in one operation and smaller amounts, as needed, are used in the preparation of the final lubricating compositions. The Small, et al patent is concerned with the prevention of a gelling tendency that mineral lubricating oil or ester type oil compositions containing these hydrogenated copolymers have. Their proposed solution is the addition of small amounts of a polyester of an olefinically unsaturated acid to the oil solution.

In accordance with the present invention, it has been found that many of the difficulties encountered in formulating lubricating compositions containing these hydrogenated interpolymers may be eliminated or diminished by first preparing an additive concentrate using a non-ester type synthetic lubricating oil diluent or carrier. This additive concentrate, which may comprise other additives and certain other types of lubricating oil diluents, is subsequently blended with the proper amount and type of lubricating oil to prepare the final lubricating compositions.

The additive concentrates of the present invention comprise a non-ester type synthetic lubricating oil diluent and from about 5% to about 50% by weight of the particular hydrogenated alkenylarene-conjugated diene interpolymer. A preferred range of concentration for the hydrogenated interpolymer is from about 5% concentrates about 30% by weight. Mixtures of two or more non-ester type synthetic lubricating oils may be used. Likewise, mixtures of two or more different hydrogenated interpolymers may be used, if desired. A supplemental diluent may be used in preparing the additive concentrate. Suitable, supplemental diluents are selected from the group consisting of ester type synthetic lubricating oils, mineral lubricating oils, and mixtures thereof. When a supplemental diluent is used, concentrations in the range of up to about 80% by weight of the total diluent concentration are useful. Preferably, the concentration of the supplemental diluent will be in the range of from about 20% to about 80% by weight of the total diluent concentration. These concentrates are normally liquid solutions or substantially stable dispersions comprising the hydrogenated interpolymer and the diluent.

The lubricating compositions of the present invention are prepared by blending the subject additive concentrate with a suitable amount and type of lubricating oil. The amount of concentrate used is sufficient to provide from about 1% to about 95% by weight of the final lubricating composition. The amount of concentrate used is, of course, dependent upon the concentration of the viscosity index improving interpolymer in the concentrate. Thus, expressed on a different basis, the amount of concentrate used will be sufficient to provide a range of from about 0.05% to about 10% by weight of the interpolymer in the final lubricating composition. A preferred range of concentration for the interpolymer in the final lubricating composition is from about 0.5% to about 5% by weight.

Suitable lubricating oils, which may be blended with the subject additive concentrate to prepare the lubricating compositions of the present invention, are selected from the group consisting of non-ester type synthetic lubricating oils, ester type synthetic lubricating oils, mineral lubricating oils, and mixtures thereof.

As used herein, and in the appended claims, the terminology of "hydrogenated alkenylarene-conjugated diene interpolymer" is used to define oil-soluble, solid, rubbery interpolymers of an alkenylarene monomer, such as styrene, and a conjugated diene monomer, such as butadiene, which have been hydrogenated to remove substantially all of the olefinic unsaturation. Usually, the degree of hydrogenation is insufficient to hydrogenate the aromatic-type unsaturation, i.e., the arene group. Although, in some situations, partial hydrogenation of the aromatic-type unsaturation is effected. These interpolymers are prepared by conventional polymerization techniques involving the formation of interpolymers having a controlled type of steric arrangement of the polymerized monomers, i.e., random, block, tapered, etc. Hydrogenation of the interpolymer is effected using conventional hydrogenation processes.

Hydrogenated alkenylarene-conjugated diene interpolymers of relatively high molecular weight are suitable herein. Such high molecular weight interpolymers include those which can be characterized as having a number average molecular weight of at least about 20,000 up to about 500,000 or higher (e.g., random interpolymers with number average molecular weights of from about 30,000). Preferred interpolymers have number average molecular weights in a range of between about 30,000 and about 150,000 . Such interpolymers are known in the prior art as will be apparent from further descriptions provided hereafter.

Suitable alkenylarene monomers include, vinyl mono-, di- or poly- aromatic compounds, such as a styrene or a vinyl naphthalene monomer. The preferred alkenylarene monomers are styrene, and substituted styrenes, such as alkylated styrene, or halogenated styrene. The alkyl group in the alkylated styrene, which may be a substituent on the aromatic ring or on an alpha carbon atom, may contain from 1 to about 20 carbons, preferably 1–6 carbon atoms. Suitable conjugated diene monomers include butadiene and alkyl-substituted butadiene, having from 1 to about 6 carbons in the alkyl substituent. Thus, in addition to butadiene, isoprene, piperylene and 2,3-dimethylbutadiene are useful as the diene monomer. Two or more different alkenylarene monomers as well as two or more different conjugated diene monomers may be polymerized to form the alkenylarene-conjugated diene interpolymers. The majority of these interpolymers known in the prior art are copolymers prepared from one type of each monomer.

A number of hydrogenated alkenylarene-conjugated diene interpolymers are known in the prior art to be effective viscosity index (VI) improvers for lubricating oils.

U.S. Pat. Nos. 3,554,911 (Schiff et al.); 3,630,905 (Sorgo); and 3,772,169 (Small et al.) are concerned with the use of hydrogenated random butadiene-styrene copolymers as VI improvers for lubricating oils. These copolymers are prepared by the copolymerization, using conventional techniques, of butadiene and styrene in the presence of a randomizing agent and subsequently, the copolymers are partially hydrogenated.

The hydrogenated copolymers have a molecular weight in the range from about 25,000 to about 125,000 with a preferred range of from about 30,000 to about 100,000. The molecular weight values are reported to be kinetic molecular weight values and are, within experimental error, the same as number average molecular weights. These copolymers contain butadiene in the range of from about 30% to about 44% by weight with the remainder, i.e., about 70% to about 56%, being styrene. Prior to hydrogenation, the copolymers have a vinyl content of less than 35% by weight. During hydrogenation, the olefinic group hydrogenation is 95% by weight or more, and the phenyl group hydrogenation is 5% by weight or less. When used as an additive, the copolymers are usually employed in the range of from about 0.5% to about 20% by weight copolymer in the final lubricating composition. A preferred range for the additive copolymer is from about 1% to about 15% by weight.

U.S. Pat. No. 3,775,329 issued to Eckert is concerned with the use of hydrogenated tapered copolymers of isoprene and monovinyl aromatic compounds as VI improvers for lubricating oil. These tapered copolymers are defined as including both "single tapered copolymers" and "multiple tapered copolymers".

These particular copolymers are derived from isoprene and a vinyl mono-, di-, or poly-aromatic compound, such as a styrene or a vinyl naphthalene. The preferred vinyl aromatic monomers are styrene, alkylated styrene, or halogen-substituted styrene. It is disclosed that copolymers derived from isoprene and styrene and/or para-tertiary butylstyrene are very useful. The copolymers are prepared by the copolymerization, using conventional techniques, of the appropriate monomers, and subsequently, the copolymers are hydrogenated using conventional techniques to the desired degree of hydrogenation. It is preferred that at least 90%, but more particularly 95%, of the olefinic unsaturated bonds originally present in the tapered copolymer are saturated in the hydrogenated product. Also, it is preferred that less than 10% and more particularly less than 5%, of the aromatic unsaturation is saturated in the final hydrogenated tapered copolymer.

The molecular weight of the tapered copolymers may vary between wide limits, for instance, between 20,000 and 500,000, and in particular between 20,000 and 400,000. Good results are obtained with polymers having a molecular weight in the range of from 20,000 to about 125,000. The molecular weights are expressed as number average molecular weights, determined by osmotic pressure method, or tritium counting procedures. When used as an additive, hydrogenated tapered copolymers are usually employed in the range of from about 0.1% to about 15% by weight, very suitable concentrations are in the range of from about 0.1% to about 9%. The preferred range of concentration of the hydrogenated tapered copolymers in a lubricating composition is from about 1% to about 6% by weight.

U.S. Pat. No. 3,752,767 issued to Eckert et al. is concerned with the use as a VI improver of hydrogenated random copolymers of a conjugated diene and a vinyl aromatic compound, in which the diene and/or the vinyl aromatic compound contains at least one alkyl substituent.

These copolymers are further defined as derived from a C4–6 conjugated diene and a styrene in which the diene and/or styrene contains at least one lower C1–6 alkyl substituent. Exemplary dienes include piperylene, 2,3-dimethylbutadiene, isoprene and butadiene. The vinyl aromatic compound is styrene or an alkylated styrene. In the alkylated styrene, the alkyl substituent may be attached to either the alpha-carbon of the styrene, i.e., alpha-methylstyrene, or to the aromatic ring, i.e., p-methylstyrene. The molar ratio between the conjugated diene and the vinyl aromatic compound varies depending upon the nature of the vinyl aromatic component, since the oil-solubility depends upon the presence or absence of an alkyl substituent in the vinyl aromatic compound. Thus, when the vinyl aromatic compound consists entirely of styrene, up to about 70 molar percent styrene may be utilized. When the vinyl aromatic compound contains an alkyl group of sufficient oil-solubilizing properties, e.g., p-t-butylstyrene, up to about 90 molar percent may be used. Copolymers with ratios of the number of units originating from the vinyl aromatic monomer to the number of units originating from the conjugated diene between 1 to 99, and 90 to 10, in particular between 5 to 95 and 85 to 15, and more particularly between 30 to 70 and 75 to 25 are very suitable.

These copolymers are prepared by copolymerization, using conventional techniques, of the appropriate vinyl aromatic and conjugated diene compounds in the presence of a randomizing agent and subsequently, the copolymers are partially hydrogenated. In the hydrogenated copolymer, at least 50% by weight of the olefinically unsaturated bonds are hydrogenated, and it is preferred that more than 95% be hydrogenated. Also, it is preferred that less than 10% in particular less than 5%, of the aromatic unsaturation originally present in the random copolymer is saturated in the final hydrogenated random copolymer. The subject hydrogenated copolymers have average molecular weights in the range from about 40,000 to about 500,000. A preferred molecular weight range is from about 40,000 to about 150,000. When used as an additive, the copolymers are usually employed in the range from about 0.1% to about 15 % by weight of the lubricating composition, with a preferred range of from about 1% to about 10% by weight.

U.S. Pat. Nos. 3,668,125, and 3,763,044, issued to Anderson are concerned with the use as a VI improver for lubricating oil of certain hydrogenated block copolymers of a conjugated diene and a vinyl aromatic compound.

The U.S. Pat. No. 3,668,125 is concerned with hydrogenated block copolymers having at least three essentially uniform polymer blocks, C and D. C represents a hydrogenated monovinyl arene, i.e. styrene, polymer block, having an average molecular weight of from about 5,000 to about 50,000. D represents a hydrogenated conjugated diene, i.e., butadiene or isoprene, polymer block having an average molecular weight from about 10,000 to about 1,000,000. In the C block, at least 50% of the original aromatic double bonds have been reduced by hydrogenation and in the D block at least 50% of the original diene unsaturation has been reduced by hydrogenation.

These block copolymers may be of either a linear or branch structure. The species having a linear structure is represented by the general formula $C—(D—C)_n$, while the species having a branched configuration is represented by the general formula $C—D—(D—C)_n$. In the above formula, n represents an integer having a value of from one to five. Details concerning the preparation of these VI improvers are set forth in the reference patent. These hydrogenated block copolymers are used in a lubricating composition in the range of from about 1.0% to about 4.5% by weight of the composition.

The U.S. Pat. No. 3,763,044 patent is concerned with a block copolymer corresponding to the general formula, A-B, wherein A represents a polymer block of the group consisting of polystyrene and hydrogenated polystyrene products, and B represents a block of hydrogenated polyisoprene. The A block has an average molecular weight of from about 5,000 to about 50,000 with a preferred range of from about 9,000 to about 35,000. The B block has an average molecular weight of between about 10,000 and about 1,000,000, with a preferred range of between 15,000 and200,000. The block copolymers are hydrogenated to reduce the olefinic unsaturation by at least about 50% and, preferably, at least about 80%. The monovinyl arene polymer block may be hydrogenated to reduce the original aromatic unsaturation by at least 50% and, preferably by 80%. Details concerning the preparation of these VI improvers are set forth in the reference patent. These hydrogenated block copolymers are used in lubricating compositions in the range of from about 0.75% to about 5%, by weight of the lubricating composition.

The above discussed patents are incorporated herein by reference to identify and to illustrate both general and specific types of hydrogenated alkenylarene-conjugated diene interpolymers useful as viscosity index improvers, which may be used to prepare the additive concentrates and lubricating compositions of the present invention.

The terminology of "non-ester type synthetic lubricating oil" is used to define oils of lubricating viscosity prepared by synthetic methods and which are not based upon compounds containing an ester linkage. More specifically, this terminology is used to define synthetic lubricating oils selected from the group consisting of the alkylated aromatic type, the polyolefin type, the chlorofluorocarbon type, and the polyphenyl ether type.

The alkylated aromatic type of synthetic lubricating oils useful in preparing the compositions of this invention are based upon oils of lubricating viscosity obtained by the alkylation of an aromatic hydrocarbon. These oils may be obtained by the reaction of a monoolefin with an aromatic compound, such as an alkylated benzene, naphthalene or tetrahydronaphthalene, usually in the presence of an alkylation catalyst, such as a Fridel-Craft type catalyst. Another method of preparing this type of synthetic lubricating oil is by the alkylation of an aromatic compound with a halogenated alkyl compound, such as chlorowax, in the presence of a Friedel-Craft type alkylation catalyst. Depending upon the particular reaction conditions employed, mono-, di-, tri-, or higher- alkylated aromatic products are obtained. Usually the product oils are mixtures of the various alkylated products. This general type of synthetic lubricating oil is known in the prior art, and further details concerning their preparation and properties may be found in the following U.S. Pat. Nos. and the references cited therein: 2,410,381; 2,424,956; 3,288,716; 3,598,739; 3,661,780; 3,725,280; 3,775,325; 3,808,134; 3,812,035; and 3,812,036.

The polyolefin type of synthetic lubricating oils useful in preparing the compositions of the present invention are based upon oils of lubricating viscosity obtained by polymerization of a variety of $C_3$–$C_{20}$ or higher olefins. These oils may be homopolymers, copolymers, or terpolymers, or mixtures obtained by known polymerization processes. This general type of synthetic lubricating oil is known in following U.S. Pat. Nos. and the references cited therein: 2,500,161; 2,500,163; 3,121,061; 3,149,178; 3,682,823; 3,725,498; 3,763,244; 3,780,128; and 3,843,537.

The polyphenyl ether type of synthetic lubricating oils useful in preparing the compositions of the present invention are based upon oils of lubricating viscosity obtained by linking together, in a linear chain, two or more benzene rings through oxygen atoms. The properties of the synthetic oils may be varied by changing the length of the chain, changing the point of attachment to the benzene ring (ortho, meta or para), or by the introduction of various inert substituents on the phenyl groups. The usual substituents for the phenyl groups are alkyl, bromo, or chloro. The usual preparative method for the polyphenyl ether type of synthetic lubricating oils involves an Ullman-type reaction. This general type of synthetic lubricating oil is known in the prior art and further information may be obtained from the following representative U.S. Pat. Nos. and the references cited therein: 3,006,852; 3,198,734; 3,203,997; 3,290,249; 3,374,175; 3,358,040; 3,374,175; 3,406,207; 3,423,469; 3,429,816; 3,441,615; 3,449,442; 3,451,061; 3,476,815; 3,565,960; 3,567,783; 3,704,277; and 3,706,803.

The terminology of "polyphenyl ether type" as used herein is inclusive of polyphenyl thioether synthetic lubricating oils as well as synthetic lubricating oils based upon polyphenyl ether-thioethers, which are useful in preparing the compositions of the present invention. These thioethers and ether-thioethers differ from the above described polyphenyl ethers in that all or a portion of the linking oxygen atoms are replaced by sulfur atoms. Again, these synthetic lubricating oils are known in the prior art, and further information may be obtained from the following representative U.S. Pat. Nos. and the references cited therein: 3,647,752; 3,634,521; 3,490,737; 3,455,846; 3,452,101; 3,450,740; 3,426,075; 3,384,670; 3,321,579; 3,321,403; and 3,311,665.

The chlorofluorocarbon type synthetic lubricating oils useful in preparing the composition of the present invention are based upon oils of lubricating viscosity obtained from linear hydrocarbon polymers in which the hydrogen atoms have been completely replaced by chlorine and fluorine atoms. The most common low molecular weight chlorofluorocarbon polymers of interest as lubricants are prepared by the polymerization or telomerization of the chlorotrifluoroethylene monomer. This is a general type of synthetic lubricating oil known in the prior art and further details concerning its preparation may be found in the following representative U.S. Pat. Nos. and the references cited therein: 2,636,907; 2,679,479; 2,793,201; 2,927,893; 2,992,991; 2,992,988; 3,002,031; 3,051,764; 3,076,765; 3,083,238; 3,089,911; and 3,091,648.

The ester type of synthetic lubricating oils useful in preparing the compositions of the present invention are based upon oils of lubricating viscosity obtained by the esterification of mono-, di-, tri-, or higher carboxylic acids with suitable primary, secondary, or tertiary alcohols. These alcohols may be mono-, di-, tri-, or polyhydric. Although other synthetic lubricating oils containing ester groups derived from inorganic acids, i.e., phosphate esters or silicate esters, are known in the prior art, these are not particularly useful for the compositions of the present invention. Thus, the organic carboxylic ester type of synthetic lubricating oils are the more useful type for the present invention.

This ester type of synthetic lubricating oil may be considered as based upon three different series of esters, depending upon the starting materials and reaction procedures used for their preparation. The first series are those derived from dibasic acid esters and results from the reaction of straight chain dibasic acids, such as sebacic, with primary branched alcohols, such as 2-ethylhexanol. The second series are those derived by the esterification of neopentyl type polyols with monobasic acids. Neopentyl glycol, trimethylolethane, trimethylolpropane and pentaerythritol, which are commercially available, are the usual neopentyl type polyols used to prepare this series of synthetic lubricating oils. The third series are complex esters derived from a dibasic acid half-ester and a glycol, or are derived from long chain monobasic acids, and a glycol half-ester of a dibasic acid.

The dibasic acid ester type of synthetic lubricating oils may be regarded as corresponding to the following general formula:

$$R'-O-\overset{O}{\overset{\|}{C}}-R-\overset{O}{\overset{\|}{C}}-O-R'$$

wherein R′ represents a radical derived from the particular alcohol esterified, and R represents a radical derived from the particular acid esterified. The more common dibasic acids used to prepare this type are adipic, azelaic, and sebacic, and the more common alcohols are $C_8$–$C_{10}$ branched chain alcohols, such as 2-ethylhexanol and $C_8$, $C_9$, and $C_{10}$ oxo alcohols.

The neopentyl type polyol esters are a group of "hindered" esters formed from monobasic carboxylic acids and a polyol derived from neopentane [$C(CH_3)_4$]. The common polyols used have been mentioned above, and the commonly used monobasic acids are those having from about 3 to about 18 carbon atoms.

The complex ester type of synthetic lubricating oils may be considered as corresponding to two general formulae.

The first series corresponds to the general formula:

PA-DBA-G-DBA-PA wherein PA represents a radical resulting from the esterification of a primary alcohol; DBA represents a radical resulting from the eterification of a dibasic acid; and G represents a radical resulting from the esterification of a glycol.

The second series of the complex ester type corresponds to the general formula:

MBA-G-DBA-G-MBA wherein MBA represents a radical resulting from the esterification of a monobasic acid; G represents a radical resulting from the esterification of a glycol; and DBA represents a radical resulting from the esterification of a dibasic acid.

Exemplary of a complex ester of the first series is an oil of lubricating viscosity obtained by the esterification of two moles of sebacic acid with one mole of polyethylene glycol (200 molecular weight) to form the dibasic acid halfester. This acidic half-ester is further esterified with two moles of 2-ethylhexanol. Exemplary of a complex ester of the second series is an oil of lubricating viscosity obtained by the esterification of two moles of polyethylene glycol (200 molecular weight) with one mole of sebacic acid to form a glycol half-ester. This alcoholic half-ester is then further esterified with two moles of pelargonic acid.

Further information concerning the various synthetic lubricants is contained in the publications, SYNTHETIC LUBRICANTS by R. c. Gunderson and A. W. Hart, published by Reinhold (N.Y., 1962), LUBRICATION AND LUBRICANTS, E. R. Braithwaite, ed., published by Elseiver Publishing Co., (N.Y., 1967), Chapter 4, pages 166 through 196, "Synthetic Lubricants", and SYNTHETIC LUBRICANTS by M. W. Ranney, published by Noyes Data Corp. (Park Ridge, N.J., 1972). These publications as well as the above-cited patents are incorporated herein by reference to establish the state of the art in regard to identifying both general and specific types of synthetic lubricants which can be used in preparing the compositions of the present invention. Further examples of suitable synthetic lubricating oils are given hereinafter.

The mineral lubricating oils useful in preparing the compositions of the present invention are the common solvent-treating or acid-treated mineral oils of the paraffinic, naphthenic, or mixed paraffinic-naphthenic types. These are discussed more fully hereinafter.

The subject additive concentrate may be formulated to contain other lubricant additives known in the prior art. A brief survey of conventional additives for lubricating compositions is contained in the publications, LUBRICANT ADDITIVES, by C. V. Smalheer and R. Kennedy Smith, published by the Lezius-Hiles Co., Cleveland, Ohio (1967) and LUBRICANT ADDITIVES, by M. W. Ranney, published by Noyes Data Corp., Park Ridge, New Jersey (1973). These publications are incorporated herein by reference to establish the state of the art in regard to identifying both general and specific types of other additives which can be used in conjunction with the additives of the present invention.

In general, these additional additives include detergents of the ash-containing type, ashless dispersants, additional viscosity index improvers, pour point depressants, anti-foam agents, extreme pressure agents, anti-wear agents, rust-inhibiting agents, oxidation inhibitors, and corrosion inhibitors.

The ash-containing detergents are the well known neutral basic alkali or alkaline earth metal salts of sulfonic acids, carboxylic acids or organo-phosphorus-containing acids. The most commonly used salts of these acids are the sodium, potassium, lithium, calcium, magnesium, strontium, and barium salts. The calcium and barium salts are used more extensively than the others. The "basic salts" are those metal salts known to the art wherein the metal is present in a stoichiometrically larger amount than that necessary to neutralize the acid. The calcium- and barium-overbased petrosulfonic acids are typical examples of such basic salts.

The extreme pressure agents, corrosion-inhibiting agents, and oxidation-inhibiting agents, are exemplified by chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyloleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite, and polypropylene substituted phenol phosphite; metal thiocarbamates, such as zinc dioctyldithiocarbamate and barium heptylphenol dithiocarbamate; and Group II metal salts of phosphorodithioic acid, such as zinc dicyclohexyl phosphorodithioate, and the zinc salts of a phosphorodithioic acid.

The ashless detergents or dispersants are a well known class of lubricant additives and are extensively discussed and exemplified in the above-cited publications by Smalheer et al and Ranney and the references cited therein. Particularly useful types of ashless dispersants are based upon the reaction products of hydrocarbon-substituted succinic acid compounds and polyamines or polyhydric alcohols. These reaction products may be post-treated with materials, such as alkylene oxides, carboxylic acids, boron compounds, carbon disulfide and alkenyl cyanides to produce further useful ashless dispersants.

Pour point depressing agents are illustrated by the polymers of ethylene, propylene, isobutylene, and poly(alkyl methacrylate). Anti-foam agents include polymeric alkyl siloxanes, poly(alkyl methacrylates), terpolymers of diacetone acrylamide and alkyl acrylates or methacrylates, and the condensation products of alkyl phenols with formaldehyde and an amine. Additional viscosity index improvers include polymerized and copolymerized alkyl methacrylates and polyisobutylenes.

When additional additives are formulated in the subject additive concentrate, they are used in concentrations sufficient to provide in the final lubricating composition concentrations in which they are normally employed in the art. Thus, they generally are used in a concentration of from about 0.001% up to about 25% by weight of total lubricating composition, depending of course, upon the nature of the additive and the nature of the lubricant composition. For example, ashless dispersants can be employed in amounts from about 0.1% to about 10% and metal-containing detergents can be employed in amounts from about 0.1% to about 20% by weight. Other additives, such as pour point depressants, extreme pressure additives, viscosity index improving agents, anti-foaming agents, and the like, are normally employed in amounts of from about 0.001% to about 10% by weight of the total composition, depending upon the nature and purpose of the particular additive.

Lubricating compositions containing the subject additive concentrate as an additive therein comprises a major proportion of a lubricating oil and a minor proportion of the additive concentrate. The additive concentrate is present in an amount sufficient to improve the viscosity index of the composition. In general, the subject concentrates are used in amounts of from about 1% to about 95% by weight of the total weight of lubricating composition. The optimum concentration for a particular additive will depend to a large measure upon the type of service the composition is to be subjected. In most applications, lubricating compositions containing from about 0.05% to about 10% by weight are useful although for certain applications such as in gear lubricants and diesel engines, compositions containing up to 15% or more may be preferred.

The subject additive concentrates can be effectively employed in a variety of lubricating compositions formulated for a variety of uses. Thus, lubricating compositions containing the subject additive are effective as crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the subject amide or thioamide additive therein.

The concentrates of the present invention are effectively employed using base oils of lubricating viscosity derived from a variety of sources. Thus, base oil derived from both natural and synthetic sources are useful for the preparation of lubricating compositions of the present invention.

The natural oils include animal oils, such as lard oil; vegetable oils, such as castor oil; and mineral oils, such as solvent-treated or acid-treated mineral oils of the paraffinic, naphthenic, or mixed paraffinic-naphthenic types. Also useful are oils of lubricating viscosity derived from coal or shale.

Many synthetic lubricants are known in the art and these are useful as a base lubricating oil for lubricating compositions containing the subject additive concentrates. Surveys of synthetic lubricants are contained in the publications, SYNTHETIC LUBRICANTS by R. C. Gunderson and A. W. Hart, published by Reinhold (N.Y., 1962), LUBRICATION AND LUBRICANTS, E. R. Braithwaite, ed., published by Elseiver Publishing Co., (N.Y., 1967), Chapter 4, pages 166 through 196, "Synthetic Lubricants", and SYNTHETIC LUBRICANTS by M. W. Ranney, published by Noyes Data Corp., (Park Ridge, N.J., 1972). These publications are incorporated herein by reference to establish the state of the art in regard to identifying both general and specific types of synthetic lubricants which can be used in conjunction with the additive concentrate of the present invention.

Thus, useful synthetic lubricating base oils include hydrocarbon oils derived from the polymerization or copolymerization of olefins, such as polypropylene, polyisobutylene and propylene-isobutylene copolymers; and the halohydrocarbon oils, such as chlorinated polybutylene. Other useful synthetic base oils include those based upon alkyl benzenes, such as dodecylbenzene, tetra-decylbenzene, and those based upon polyphenyls, such as biphenyls and terphenyls.

Another known class of synthetic oils useful as base oils for the subject lubricant compositions are those based upon alkylene oxide polymers and interpolymers, and those oils obtained by the modification of the terminal hydroxy groups of these polymers, (i.e., by the esterification or etherification of the hydroxy groups). Thus, useful base oils are obtained from polymerized ethylene oxide or propylene oxide or from the copolymers of ethylene oxide and propylene oxide. Useful oils include the alkyl and aryl ethers of the polymerized alkylene oxides, such as methylpolyisopropylene glycol ether, diphenyl ether of polyethylene glycol, and diethyl ether of propylene glycol. Another useful series of synthetic base oils is derived from the esterification of the terminal hydroxy group of the polymerized alkylene oxides with mono- or polycarboxylic acids. Exemplary of this series is the acetic acid esters or mixed $C_3$–$C_8$ fatty acid esters or the $C_{13}$Oxo acid diester of tetraethylene glycol.

Another suitable class of synthetic lubricating oil comprise the esters of dicarboxylic acids, such as phthalic acid, succinic acid, oleic acid, azelaic acid, suberic acid, sebacic acid, with a variety of alcohols. Specific examples of these esters include dibutyl adipate, di(2-ethylhexyl)-sebacate, and the like. Complex esters of saturated fatty acids and a dihydroxy compound, such as 3-hydroxy-2,2-dimethylpropyl 2,2-dimethylhydracrylate (U.S. Pat. No. 3,759,862), are also useful. Silicone based oils such as polyalkyl-, polyaryl-, polyalkoxy-, or polyaryloxy-siloxane oils and the silicate oils, i.e., tetraethyl silicate, comprise another useful class of synthetic lubricants. Other synthetic lubricating oils include liquid esters of phosphorus-containing acid, such as tricresyl phosphate, polymerized tetrahydrofurans, and the like.

Unrefined, refined, and re-refined oils of the type described above are useful as base oil for the preparation of lubricant compositions of the present invention. Unrefined oils are those obtained directly from a natural or synthetic source without further purification or treatment. For example, a shale oil obtained directly from retorting operations, a petroleum oil obtained directly from distillation, or an ester oil obtained directly from an esterification process, and used without further treatment are unrefined oils. Refined oils are similar to the unrefined oils, except they have been further treated in one or more purification steps, to improve one or more properties. Many such purification techniques are known in the art, such as solvent extraction, acid or base extraction, filtration, percolation, etc. Rerefined oils are obtained by a variety of processes similar to those used to obtain refined oils. The rerefined oils are also known as reclaimed or reprocessed oils and have been treated by additional techniques directed to the removal of spent additives and oil breakdown products.

A clearer understanding of the additive concentrates of the present invention, processes for their preparation, and lubricating compositions containing these concentrates may be obtained from the examples given below, which illustrate the presently preferred best modes of carrying out this invention.

EXAMPLE 1

A 15% additive concentrate is prepared by heating for about two hours at 120° C. a mixture of 85 grams of an alkylated aromatic synthetic lubricating oil and 15 grams of a hydrogenated random butadiene-styrene copolymer having a molecular weight of about 70,000 and a butadiene content of about 40% by weight.

The alkylated aromatic lubricating oil is a commercially available mono-alkylated benzene, having a molecular weight in the range of from about 231 to 241 and is predominately a $C_{12}$ alkylated benzene.

A lubricating composition suitable for use as an automatic transmission fluid is prepared using a 100 neutral mineral lubricating oil as the base oil, and as additives: 8% of the above 15% additive concentrate; 0.5% of a mineral oil solution of a viscosity improver derived from mixed esters of a styrene-maleic acid interpolymer as disclosed in U.S. Pat. No. 3,702,300; and 6% of a mineral oil based concentrate containing (1) 66% of an ashless dispersant, which is the reaction product (1:1 equivalent) of polyisobutenyl succinic anhydride and tetraethylenepentamine prepared according to the procedure of U.S. Pat. No. 3,172,892; (2) 11.8% of a zinc isooctyl phosphorodithioate oxidation inhibitor; (3) 16.47% of an overbased barium sulfonate detergent; (4) 3.24% of a conventional friction modifier, based upon Polyoxyethylene (2) Tallow Amine (Ethomeen T/12); and (5) 0.33% of a conventional silicone-based anti-foaming agent.

EXAMPLE 2

Following the general procedure of Example 1, the 15% additive concentrate is used to prepare a similar lubricating composition containing 10% of the additive concentrate. An additional lubricating composition is prepared using an additive concentrate containing 12% of the copolymer.

EXAMPLE 3

Following the general procedure of Example 1, a 15% additive concentrate is prepared using a hydrogenated tapered copolymer of isoprene-styrene prepared in accordance with the procedure of Experiment No. B, of U.S. Pat. No. 3,775,329. This concentrate is used to prepare lubricating compositions suitable for use as automatic transmission fluids.

EXAMPLE 4

A 15% additive concentrate of a viscosity index improver is prepared from 85 grams of a polyisobutylene (molecular weight 900) synthetic lubricating oil and 15 grams of the hydrogenated random butadiene-styrene copolymer described in Example 1.

EXAMPLE 5

An additive concentrate is prepared using 69.75% of the concentrate of Example 4, and 30.25% of a mineral oil based concentrate containing (1) 58.4% of a dispersant based upon the reaction product of polyisobutenyl succinic anhydride, pentaerythritol, a poly(oxyethylene) (oxypropylene)glycerol, and polyethylene polyamine as described in U.S. Pat. No. 3,836,470; (2) 16.9% of a zinc isobutylamyl phosphorodithioate oxidation inhibitor; (3) 22.3% of an overbased calcium sulfonate detergent; and (4) 0.07% of a conventional anti-foaming agent.

EXAMPLE 6

A lubricating composition suitable for use as a crankcase lubricant is prepared using an alkylated aromatic lubricating base oil, and 23.8% of the concentrate of Example 5.

The alkylated aromatic synthetic lubricating oil is, predominately, a di- and tri-alkylated benzene prepared by the alkylation of, predominately, monoalkylated ($C_{13}$–$C_{14}$) benzene with 1-octene (2 moles of octene per mole of monoalkylated benzene) in the presence of a catalytic amount (1% by weight) of aluminum trichloride.

EXAMPLE 7

A lubricating composition suitable for use as a crankcase lubricant is prepared using a dibasic acid ester type synthetic lubricating base oil and 23.8% of the concentrate of Example 5.

The dibasic acid ester synthetic lubricating oil used is based, predominately, upon diisooctyl acelate.

EXAMPLE 8

A lubricating composition suitable for use as a crankcase lubricant is prepared using a neopentyl type polyol ester synthetic lubricating base oil and 23.8% of the concentrate of Example 5.

The neopentyl type polyol ester synthetic lubricating oil used is based, predominately, upon esters of pentaerythritol and a mixture of $C_6$14 $C_{10}$ aliphatic monocarboxylic acids.

EXAMPLE 9

A 10% additive concentrate of a viscosity index improver is prepared using 10 grams of the hydrogenated random butadiene-styrene copolymer described in Example 1, and 90 grams of an alkylated polyphenyl ether lubricating base oil. The alkylated polyphenyl ether synthetic lubricating oil is, predominately, a monoalkylated diphenyl oxide. This synthetic oil is prepared by the alkylation of diphenyl oxide with a $C_{12}$ alpha-olefin in the presence of about 5% of an acidic clay catalyst.

EXAMPLE 10

A 9% additive concentrate of a viscosity index improver is prepared using 9 grams of the hydrogenated random butadiene-styrene copolymer described in Example 1, and 91 grams of the alkylated aromatic lubricating base oil described in Example 6.

EXAMPLE 11

A lubricating composition suitable for use as a gear lubricant is prepared using as the base oil the alkylated aromatic synthetic lubricating oil described in Example 6, 33% of the concentrate prepared in Example 10, 0.5% of a pour-point depressant based upon a fumarate-vinylacetate-ethyl vinyl ether interpolymer as described in U.S. Pat. No. 3,250,715; and 6.5% of a mineral oil based additive concentrate containing (1) 20.3% of a reaction product prepared according to the procedure of U.S. Pat. No. 3,197,405, of a hydroxy-substituted triester of a phosphorothioic acid, phosphorus pentaoxide, and a commercial aliphatic primary amine having an average molecular weight of 191, in which the aliphatic radical is a mixture of tertiary alkyl radicals containing 11 to 14 carbon atoms; (2) 5.4% of oleylamine (Armeen O) as a combination slip agent and rust inhibitor; (3) 1.5% of a slip agent based upon a commercially available mixture of oleamide and linoleamide (Armid O); (4) 2.4% of a copper deactivator based upon dimethylthiadiazole; (5) 1.2% of a conventional anti-foaming agent based upon a polymer of 2-ethylhexyl acrylate and ethyl acrylate; and (6) 68% of an EP agent based upon sulfurized isobutylene.

EXAMPLE 12

A 10% additive concentrate of a viscosity index improver is prepared using 10 grams of the hydrogenated random butadiene-styrene copolymer described in Example 1, and 90 grams of the alkylated aromatic synthetic lubricating base oil described in Example 6.

EXAMPLE 13

A lubricating composition suitable for use as a hydraulic oil is prepared using as the base oil a mixture of 75% of the alkylated aromatic lubricating oil of Example 6, and 25% of a commercially available bright stock (Gulf 150 BS) and as additives: 20% of the additive concentrate of Example 12; 0.5% of a pour-point depressant based on a fumarate-vinyl acetate-ethyl vinyl ether interpolymer as described in U.S. Pat. No. 3,250,715; and 1% of a mineral oil based additive concentrate containing (1) 90% of a zinc methylamyl phosphorodithioate oxidation inhibitor; and (2) 5% of a partially esterified (approximately 5%) reaction product of dodecenyl succinic acid and propylene oxide, as a rust inhibitor.

In all of the above examples, as well as in the other portions of the specification and claims, all percentages are expressed as percentage by weight, and all parts are expressed as parts by weight, unless otherwise indicated. Likewise, all temperatures are expressed in degrees centrigrade (°C), unless otherwise indicated. Likewise, the singular forms of "a", "an" and "the" include the plural, unless the context clearly dictates otherwise. Thus, for example, "an interpolymer" includes mixtures of interpolyers.

What is claimed is:

1. An additive concentrate comprising a non-ester type synthetic lubricating oil diluent and from about 5% to about 50% by weight of a hydrogenated alkenylareneconjugated diene interpolymer having a number average molecular weight in a range beginning at about 20,000.

2. The additive concentrate of claim 1, wherein a supplemental diluent is present in the range of up to about 80% by weight of the total diluent concentration and the supplemental diluent is selected from the group consisting of ester type synthetic lubricating oils, mineral lubricating oils and mixtures thereof.

3. The additive concentrate of claim 1, wherein the interpolymer is present in the range of from about 5% to about 30% by weight of the concentrate.

4. The additive concentrate of claim 1, wherein the interpolymer is a hydrogenated random butadiene-styrene copolymer having a butadiene content in the range of from about 30% to about 44% by weight and a number average molecular weight in the range of from about 25,000 to about 125,000.

5. The additive concentrate of claim 4, wherein the non-ester type synthetic lubricating oil is an alkylated aromatic type.

6. The additive concentrate of claim 4, wherein the non-ester type synthetic lubricating oil is a polyolefin type.

7. The additive concentrate of claim 4, wherein the non-ester type synthetic lubricating oil is a polyphenylether type.

8. The additive concentrate of claim 1, wherein the non-ester type synthetic lubricating oil is an alkylated aromatic type.

9. The additive concentrate of claim 8, wherein the interpolymer is present in the range of up to about 30% by weight of the concentrate and is a hydrogenated random butadiene-styrene copolymer, having a butadiene content in the range of from about 30% to about 44% by weight and a number average molecular weight in the range of from about 25,000 to about 125,000.

10. A lubricating composition comprising a lubricating oil and from about 1% to about 95% by weight of an additive concentrate comprising a non-ester type synthetic lubricating oil diluent and from about 5% to about 50% by weight of the additive concentrate of a hydrogenated alkenylarene-conjugated diene interpolymer having a number average molecular weight in a range beginning at about 20,000.

11. The lubricating composition of claim 10, wherein the lubricating oil is selected from the group consisting of non-ester type synthetic lubricating oils, ester type synthetic lubricating oils, mineral lubricating oils, and mixtures thereof.

12. The lubricating composition of claim 10, wherein a supplemental diluent is present in the additive concentrate in a range of up to about 80% by weight of the total diluent concentration and the supplemental diluent is selected from the group consisting of ester type synthetic lubricating oils, mineral lubricating oils, and mixtures thereof.

13. The lubricating composition of claim 10, wherein the interpolymer is present in the range of from about 0.5% to about 5% by weight of the lubricating composition.

14. The lubricating composition of claim 10, wherein the interpolymer is a hydrogenated random butadiene-styrene copolymer having a butadiene content in the range of from about 30% to about 44% by weight and a number average molecular weight in the range of from about 25,000 to about 125,000.

15. The lubricating composition of claim 14, wherein the non-ester type synthetic lubricating oil diluent of the additive concentrate is an alkylated aromatic type.

16. The lubricating composition of claim 14, wherein the non-ester type synthetic lubricating oil diluent of the additive concentrate is a polyolefin type.

17. The lubricating composition of claim 14, wherein the non-ester type synthetic lubricating oil diluent of the additive concentrate is a polyphenyl ether type.

18. The lubricating composition of claim 10, wherein the non-ester type synthetic lubricating oil diluent of the additive concentrate is an alkylated aromatic type.

19. The lubricating composition of claim 18, wherein the interpolymer is present in the range of up to about 30% by weight of the additive concentrate and is a hydrogenated random butadiene-styrene copolymer having a butadiene content in the range of from about 30% to about 44% by weight and a number average molecular weight in the range of from about 25,000 to about 125,000.

* * * * *